US010512372B2

(12) United States Patent
Back

(10) Patent No.: US 10,512,372 B2
(45) Date of Patent: Dec. 24, 2019

(54) TOILET ACCESSORY HOLDER

(71) Applicant: Invisibowl, LLC, Carmel, IN (US)

(72) Inventor: Trevor J. Back, Carmel, IN (US)

(73) Assignee: Invisibowl, LLC, Carmel, IN (US)

( * ) Notice: Subject to any disclaimer, the term of this patent is extended or adjusted under 35 U.S.C. 154(b) by 11 days.

(21) Appl. No.: 15/842,243

(22) Filed: Dec. 14, 2017

(65) Prior Publication Data

US 2018/0184860 A1 Jul. 5, 2018

Related U.S. Application Data

(60) Provisional application No. 62/441,400, filed on Jan. 1, 2017.

(51) Int. Cl.
*A47K 13/30* (2006.01)
*A47K 11/10* (2006.01)

(52) U.S. Cl.
CPC ..... *A47K 13/302* (2013.01); *A47K 11/10* (2013.01)

(58) Field of Classification Search
CPC ..... A47K 13/302; A47K 11/10; A47K 17/00
USPC ..... 4/300
See application file for complete search history.

(56) References Cited

U.S. PATENT DOCUMENTS

| | | | | |
|---|---|---|---|---|
| 3,361,507 A * | 1/1968 | O'Neil | A47K 17/00 206/361 |
| 3,450,452 A * | 6/1969 | Reid | A47K 17/00 206/361 |
| 3,883,197 A * | 5/1975 | Reid | A47K 11/10 312/206 |
| 2009/0106922 A1* | 4/2009 | Groendahl | A47K 11/10 15/160 |
| 2018/0049604 A1* | 2/2018 | Bham | A47K 11/10 |

* cited by examiner

*Primary Examiner* — Huyen D Le
(74) *Attorney, Agent, or Firm* — Barnes & Thornburg LLP

(57) ABSTRACT

A toilet system includes a toilet accessory and an accessory holder means. The toilet accessory is adapted for use with a toilet. The toilet accessory includes a head and a grip sized to be held in the hand of a user. The accessory holder means is configured to mount the toilet accessory to a water tank of the toilet.

20 Claims, 8 Drawing Sheets

TOILET ACCESSORY HOLDER

PRIORITY CLAIM

This application claims priority under 35 U.S.C. § 119(e) to U.S. Provisional Application Ser. No. 62/441,400, filed Jan. 1, 2017, which is expressly incorporated by reference herein.

BACKGROUND

The present disclosure relates generally to toilet accessories such as toilet brushes, plungers, and other items used in/around the toilet. More specifically the present disclosure is directed to toilet accessories used along with accessory holders configured to support the toilet accessories.

SUMMARY

A toilet system according to this application includes a toilet having a stool, a water tank, and a lid. The stool defines a front side of the toilet and is configured to hold water therein. The water tank is fluidly coupled to the stool and defines a back side of the toilet. The lid closes the water tank to block access into the water tank.

In illustrative embodiments, the toilet system includes a toilet accessory and an accessory holder. The accessory holder provides means for mounting the toilet accessory to the water tank for movement between a hidden position and a revealed position so that the toilet accessory is conveniently located, but hidden from view when not in use. The toilet accessory may include any item adapted for use in the vicinity of the toilet or surrounding toilet area. For example, the toilet accessory may include a brush for cleaning the bowl, a plunger, a container of toilet bowl cleaner, or other container such as a canister of fragrant spray.

In illustrative embodiments, the toilet accessory includes a head and a grip sized to be held in the hand of a user. The head may include, for example, a plurality of bristles and the grip may include a handle that extends from the bristles. When the toilet accessory is mounted by the accessory holder in the hidden position, at least a portion of the grip is blocked from view behind the water tank. When the toilet accessory is mounted by the accessory holder in the revealed position, the previously hidden portion of the grip is visible to a user so that the user can remove the toilet accessory from the accessory holder for use.

In illustrative embodiments, the accessory holder includes a hanger and an accessory support configured to engage and support the toilet accessory above ground underlying the stool of the toilet. The hanger is coupled to the water tank of the toilet. The accessory support is coupled to the hanger and configured to rotate relative to the hanger to move between a first position corresponding with the toilet accessory being in the hidden position and a second position corresponding with the toilet accessory being in the revealed position.

In illustrative embodiments, the head of the toilet accessory is arranged around a central axis of the head. The grip of the toilet accessory is spaced apart from the axis to provide space for the water tank when the toilet accessory is supported by the holder means. The toilet accessory further includes an offset neck that extends from the axis to the grip of the toilet accessory.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1 is a perspective view of a toilet system showing that the toilet system includes a toilet, a toilet accessory comprising a brush adapted for use with the toilet, and an accessory holder that provides means for mounting the toilet accessory to a water tank of the toilet, the accessory holder is configured to support the toilet accessory in a hidden position, as shown in FIG. 1, and a revealed position, shown in FIG. 2, so that a user can remove the toilet accessory from the accessory holder;

Figure 7:
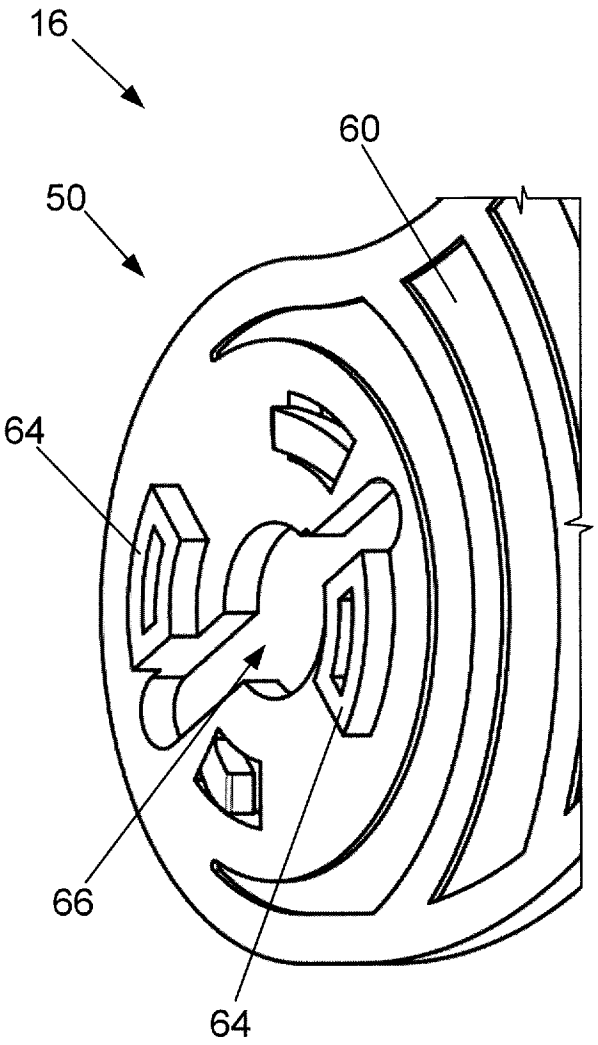
Figure 6:
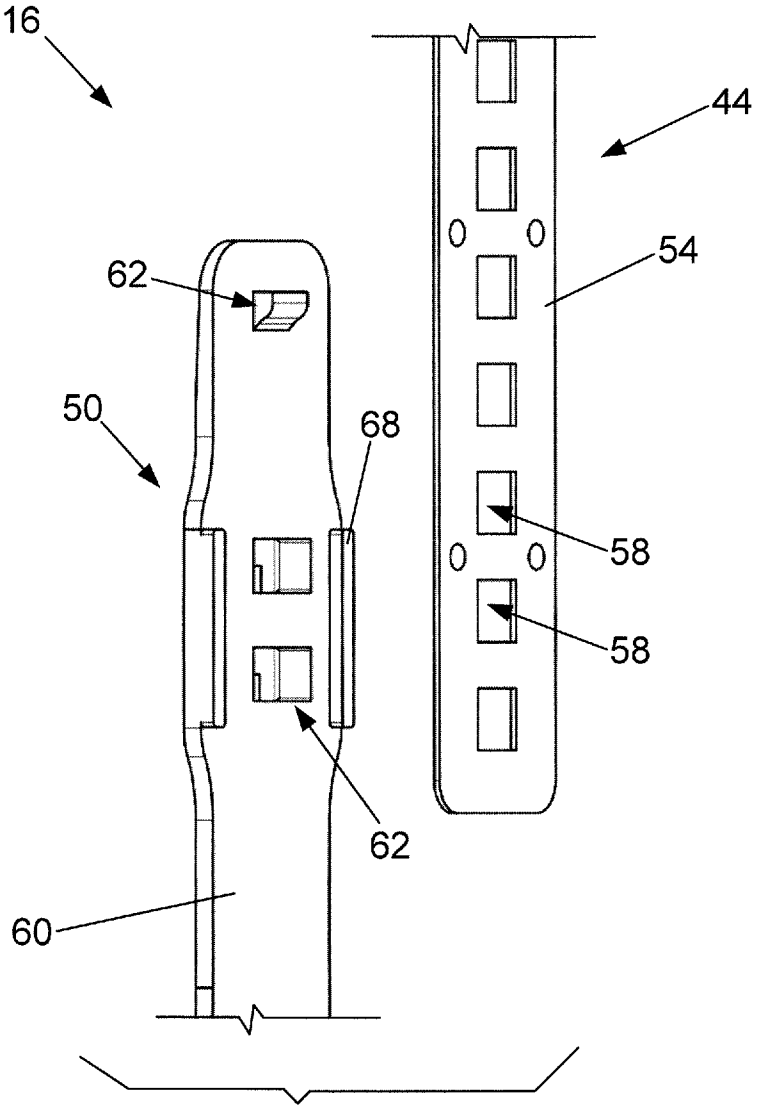
Figure 9:
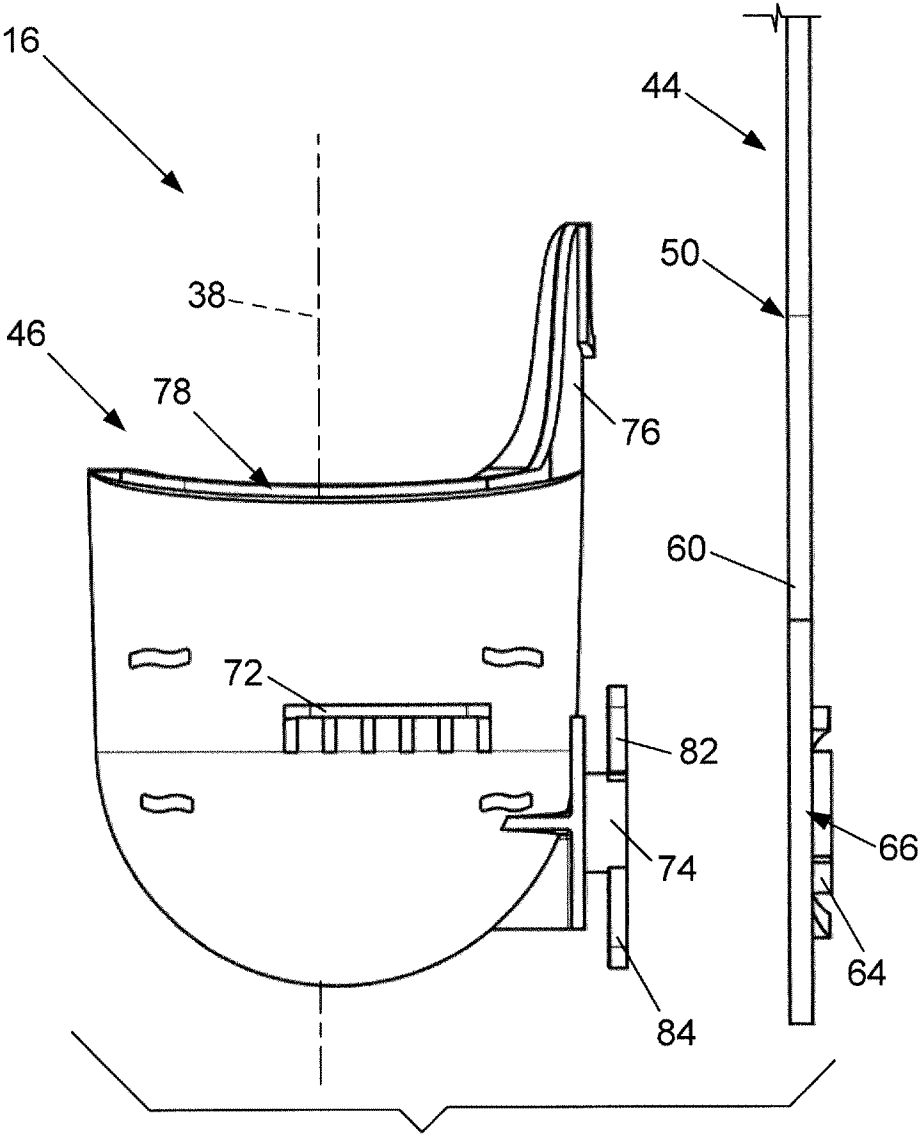
Figure 8:
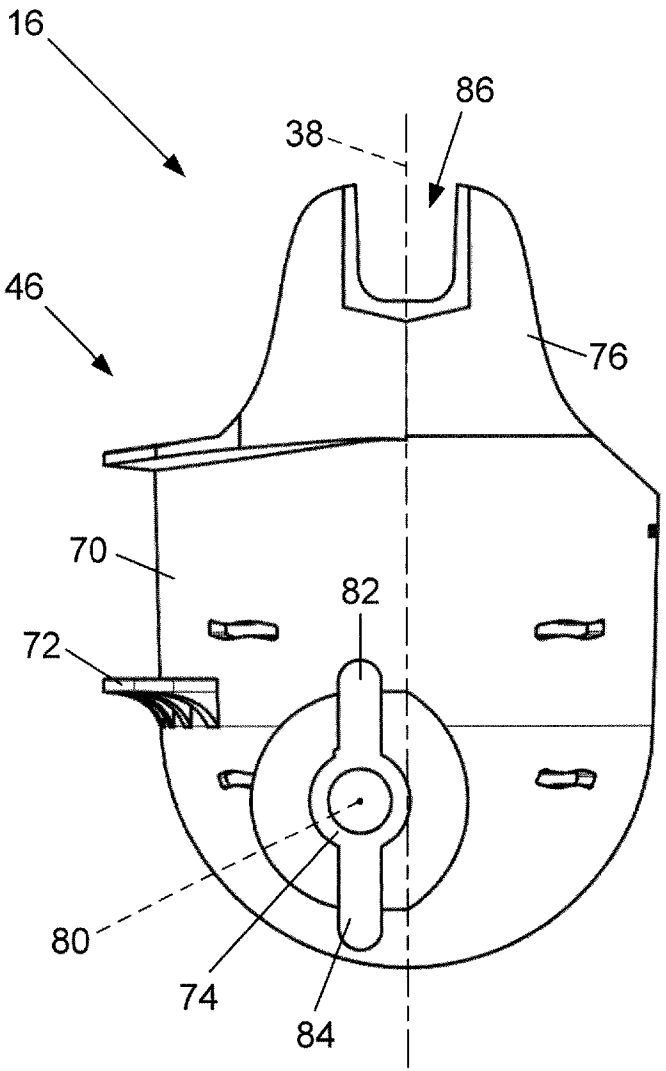
Figure 11:
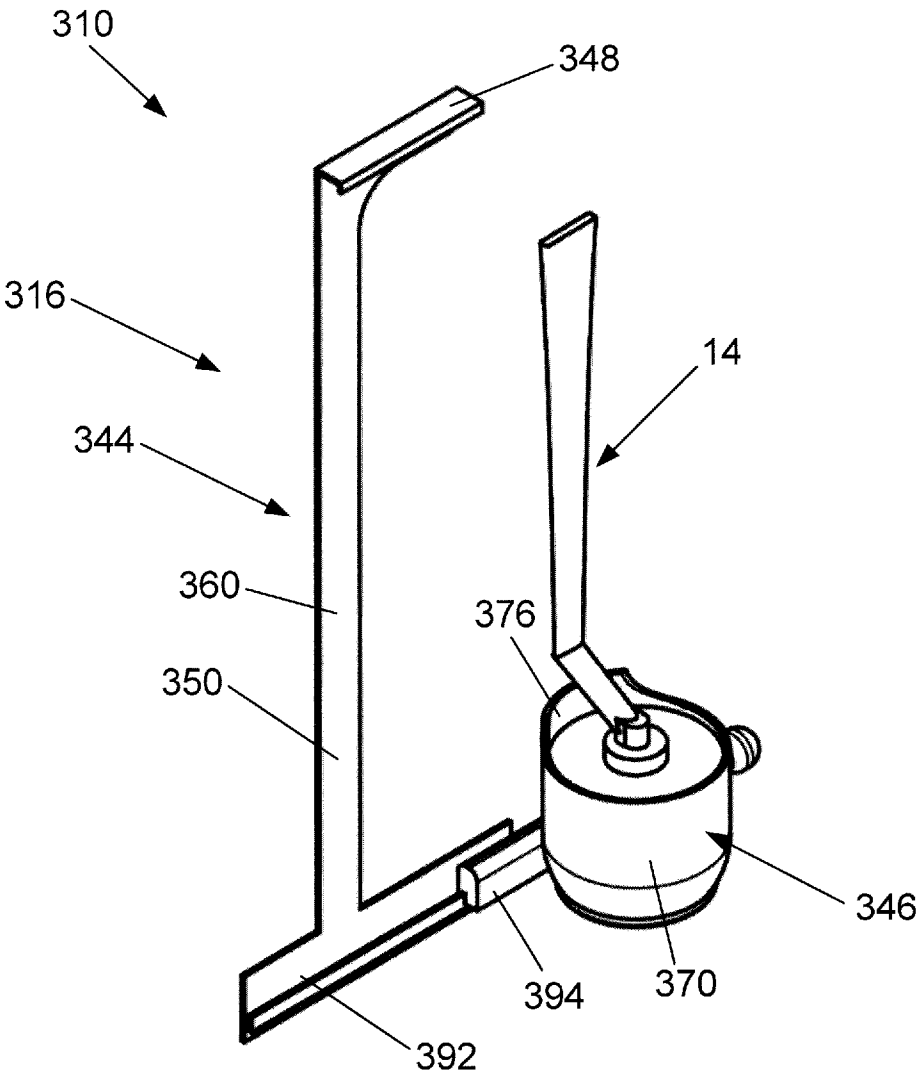
Figure 10:
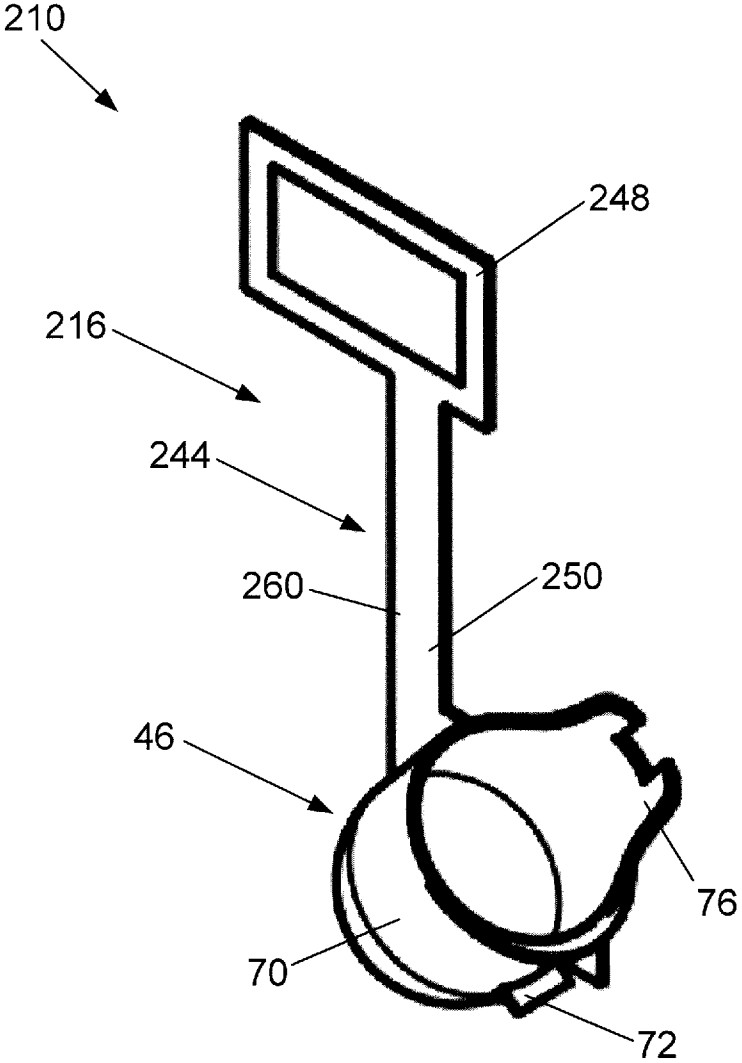
Figure 13:
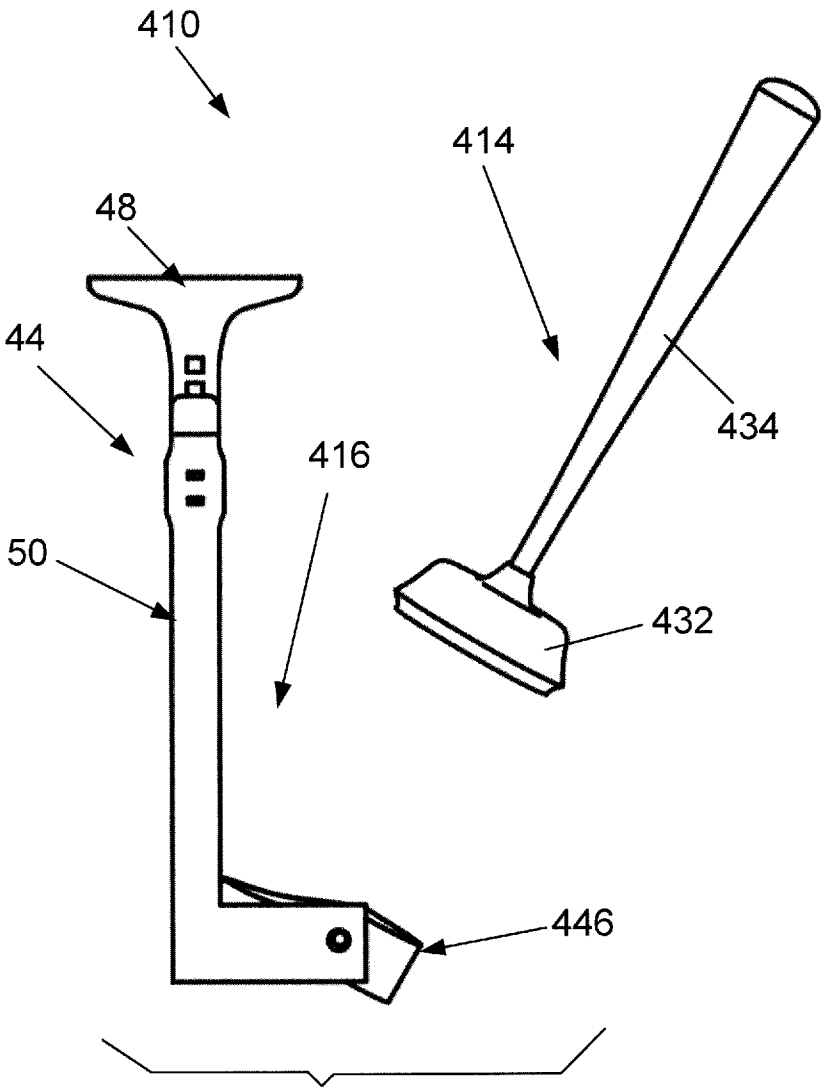
Figure 12:
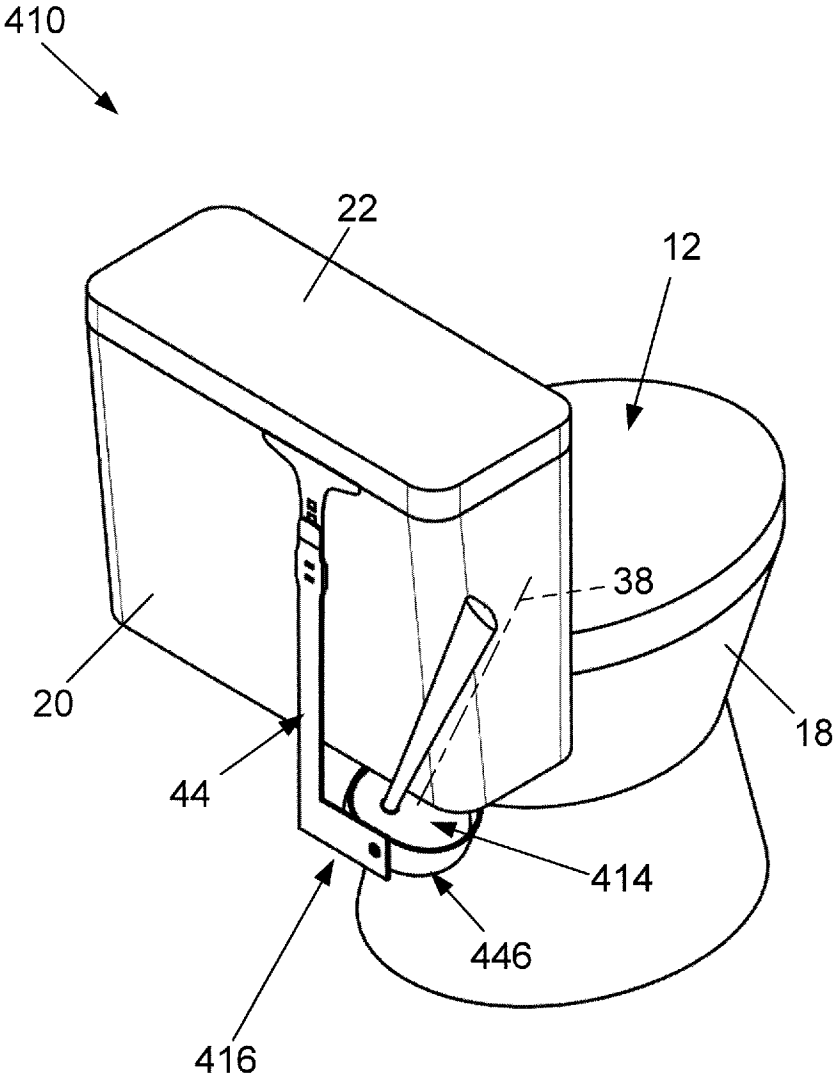
Figure 15:
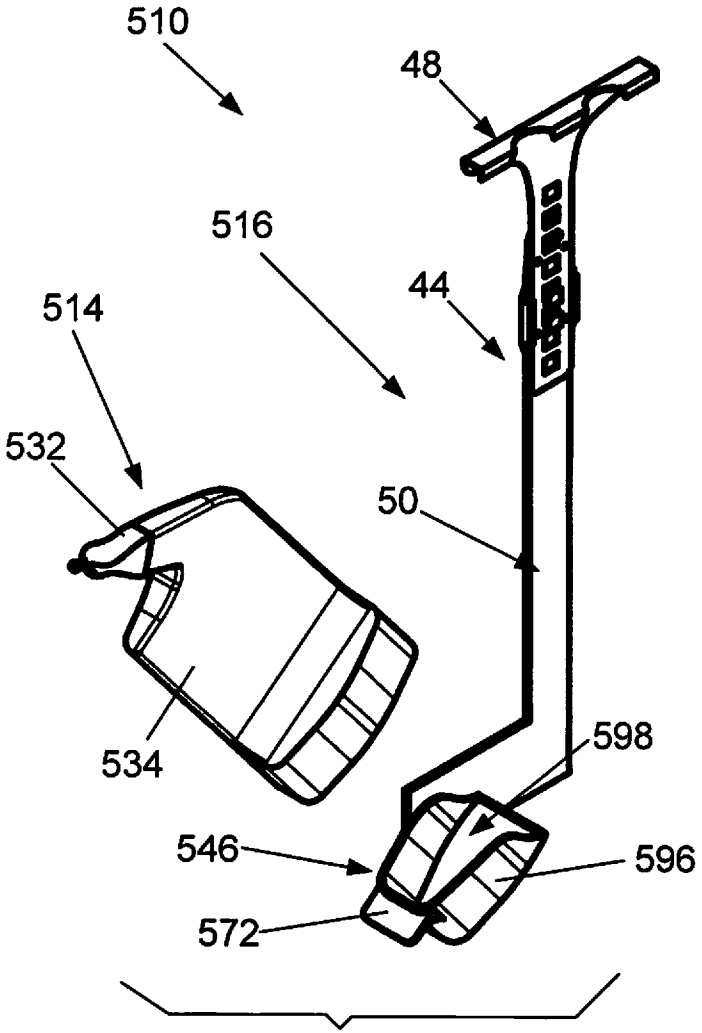
Figure 14:
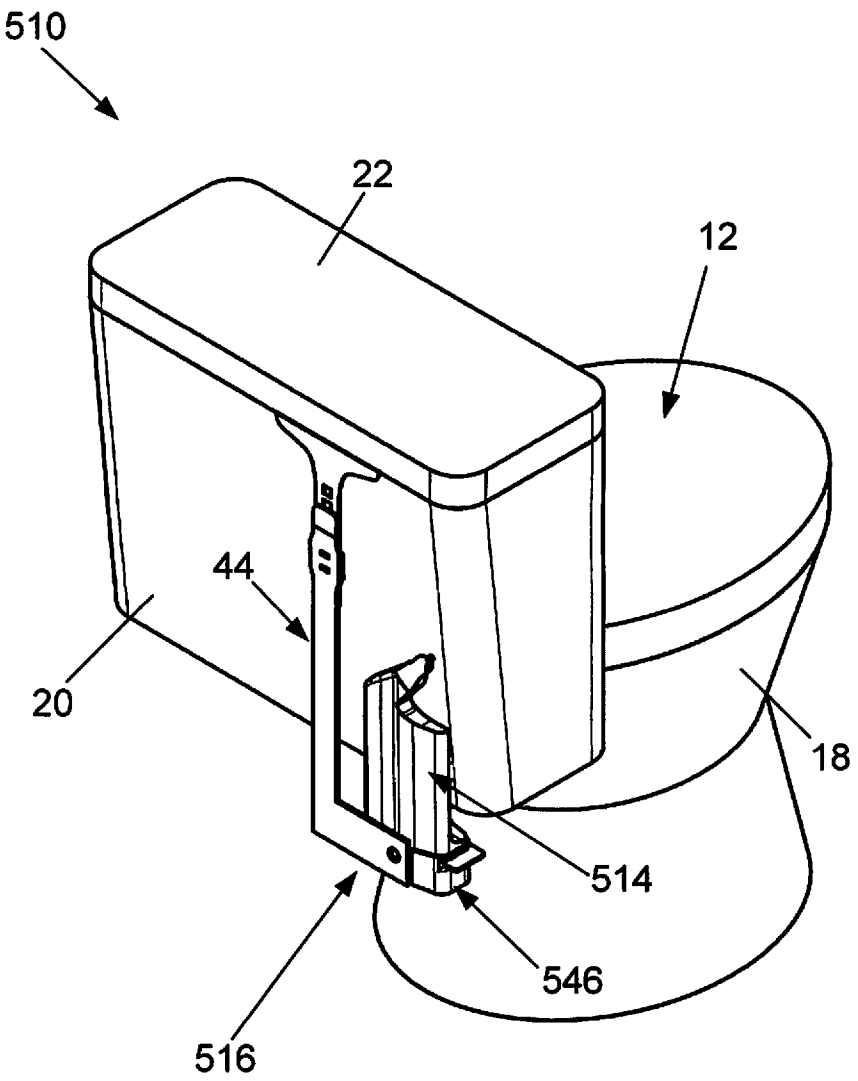

FIG. 6 is a perspective view of the hanger included in the accessory holder showing that the bracket included in the hanger includes a plurality of locating apertures formed therein, and showing that the locator arm included in the hanger includes a plurality of locator tabs that are configured to extend into corresponding locating apertures to couple the locator arm with the bracket in a plurality of positions;

FIG. 7 is a perspective view of the hanger included in the holder means showing that the hanger includes a flange-receiver slot configured to receive the connector flange of the accessory support and a plurality of stop tabs configured to limit rotation of the accessory support relative to the hanger;

FIG. 8 is a rear elevation view of the accessory support included in the accessory holder showing that the accessory support includes an accessory-support cup shaped to receive the toilet accessory and a connector flange configured to rotatably couple the accessory support with the hanger;

FIG. 9 is a side elevation view of the toilet accessory and the accessory holder suggesting that the connector flange included in the accessory support is configured to extend into the flange-receiver slot formed in the hanger to couple the accessory support with the hanger;

FIG. 10 is a perspective view of another embodiment of an accessory holder in accordance with the present disclosure showing that the bracket included in the hanger of the accessory holder includes adhesive to couple the bracket with the toilet;

FIG. 11 is a perspective view of another embodiment of an accessory holder in accordance with the present disclosure showing that the locator arm included in the hanger of the accessory holder includes a slide rail coupled with the accessory support and configured to slide the accessory support to move the accessory holder between a first position corresponding with the toilet accessory being supported in the hidden position and a second position corresponding with the toilet accessory being supported in the revealed position;

FIG. 12 is a perspective view of another embodiment of a toilet system in accordance with the present disclosure showing that the toilet system includes a toilet, a toilet accessory comprising a plunger, and an accessory holder configured to support the toilet accessory and move between a first position corresponding with the toilet accessory being supported in a hidden position and a second position corresponding with the toilet accessory being supported in a revealed position so that a user can remove the toilet accessory from the accessory holder;

FIG. 13 is an elevation view of the toilet accessory and the accessory holder included in the toilet system of FIG. 12;

FIG. 14 is a perspective view of another embodiment of a toilet system in accordance with the present disclosure showing that the toilet system includes a toilet, a toilet accessory comprising a container, and an accessory holder configured to support the toilet accessory and move between a first position corresponding with the toilet accessory being supported in a hidden position and a second position corresponding with the toilet accessory being supported in a revealed position so that a user can remove the toilet accessory from the accessory holder; and FIG. 15 is a perspective view of the toilet accessory and the accessory holder included in the toilet system of FIG. 14.

DETAILED DESCRIPTION

A toilet system 10 includes a toilet 12, a toilet brush accessory 14, and an accessory holder 16 as shown in FIGS. 1-9. A second embodiment of a toilet system 210 including the toilet 12, the toilet brush accessory 14, and an accessory holder 216 is shown in FIG. 10. A third embodiment of a toilet system 310 including the toilet 12, the toilet brush accessory 14, and an accessory holder 316 is shown in FIG. 11. A fourth embodiment of a toilet system 410 including the toilet 12, a toilet plunger accessory 414, and accessory holder 416 is shown in FIGS. 12 and 13. A fifth embodiment of a toilet system 510 including the toilet 12, a toilet cleaner container accessory 514, and an accessory holder 516 is shown in FIGS. 14 and 15.

Figure 2:
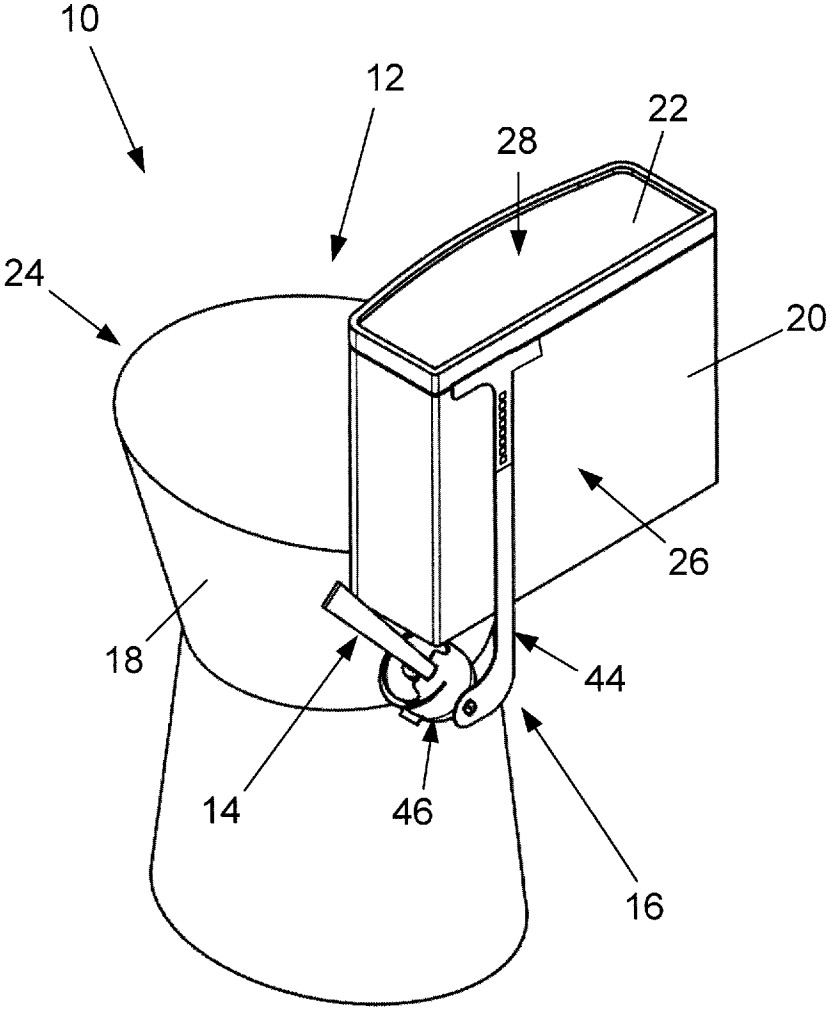
FIG. 2 is a perspective view of the toilet system of FIG. 1 showing the accessory holder in the revealed position in which an accessory support of the accessory holder is rotated relative to a hanger of the accessory holder to reveal the toilet accessory from behind the toilet so that the user can remove the toilet accessory from the accessory holder.
Figure 1:
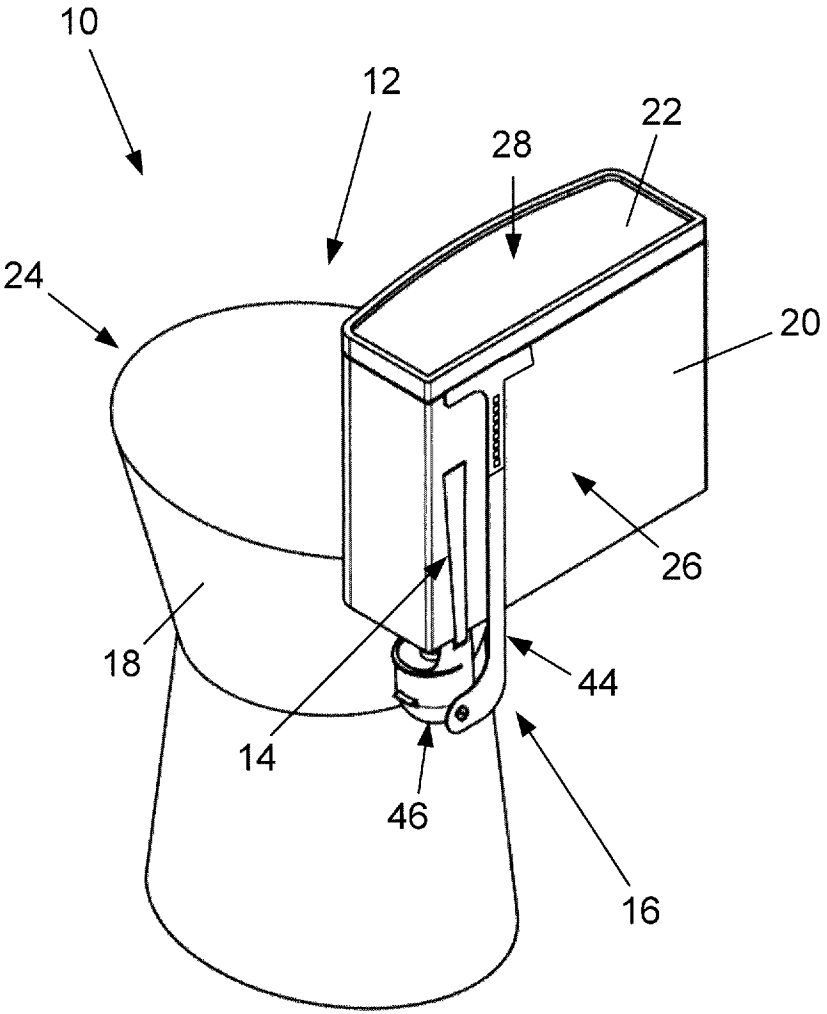

The first shown toilet system 10 includes the toilet 12, the toilet brush accessory 14, and the accessory holder 16 as shown in FIGS. 1 and 2. The toilet 12 provides a sanitation facility for collecting and disposing of human waste. The toilet accessory 14 is adapted for use with the toilet 12 and may be configured to clean and maintain the toilet 12. For example, the toilet accessory 14 may include a brush, a plunger, or container of fluid such as fragrant spray. The accessory holder 16 mounts the toilet accessory 14 to the toilet 12.

The accessory holder 16 is movable between a first position and a second position as shown in FIGS. 1 and 2. In the first position, the accessory holder 16 supports the toilet accessory 14 in a hidden position, shown in FIG. 1. In the second position, the accessory holder 16 supports the toilet accessory 14 in a revealed position, shown in FIG. 2.

The toilet accessory 14 assumes the hidden position when the accessory holder 16 is in the first position and the accessory 14 is supported in the accessory holder 16 as shown in FIG. 1. At least a portion of the toilet accessory 14 is blocked from view behind the toilet 12 when the toilet accessory is in the hidden position. The toilet accessory 14 assumes the revealed position when the accessory holder 16 is in the second position with the accessory 14 supported in the accessory holder 16 as shown in FIG. 2. The previously hidden portion of the toilet accessory 14 is visible to a user so that the user can remove the toilet accessory 14 from the accessory holder 16 when the toilet accessory is in the revealed position. Accordingly, the accessory holder 16 allows the toilet accessory 14 to be supported off the floor and out of sight when not in use while also making the toilet accessory 14 easily accessible to a user.

The toilet 12 includes a stool 18, a water tank 20, and a lid 22 as shown in FIG. 1. The stool 18 defines a front side 24 of the toilet 12 and is configured to support a person thereon. The stool 18 may hold a quantity of water and is adapted to collect and dispose of human waste. The water tank 20 defines a back side 26 of the toilet 12 and is fluidly coupled to the stool 18 to refill the stool 18 with water. The lid 22 defines a top side 28 of the toilet 12 and lies on the water tank 20 to close the water tank 20 and block access to the water in the water tank 20.

Figure 3:
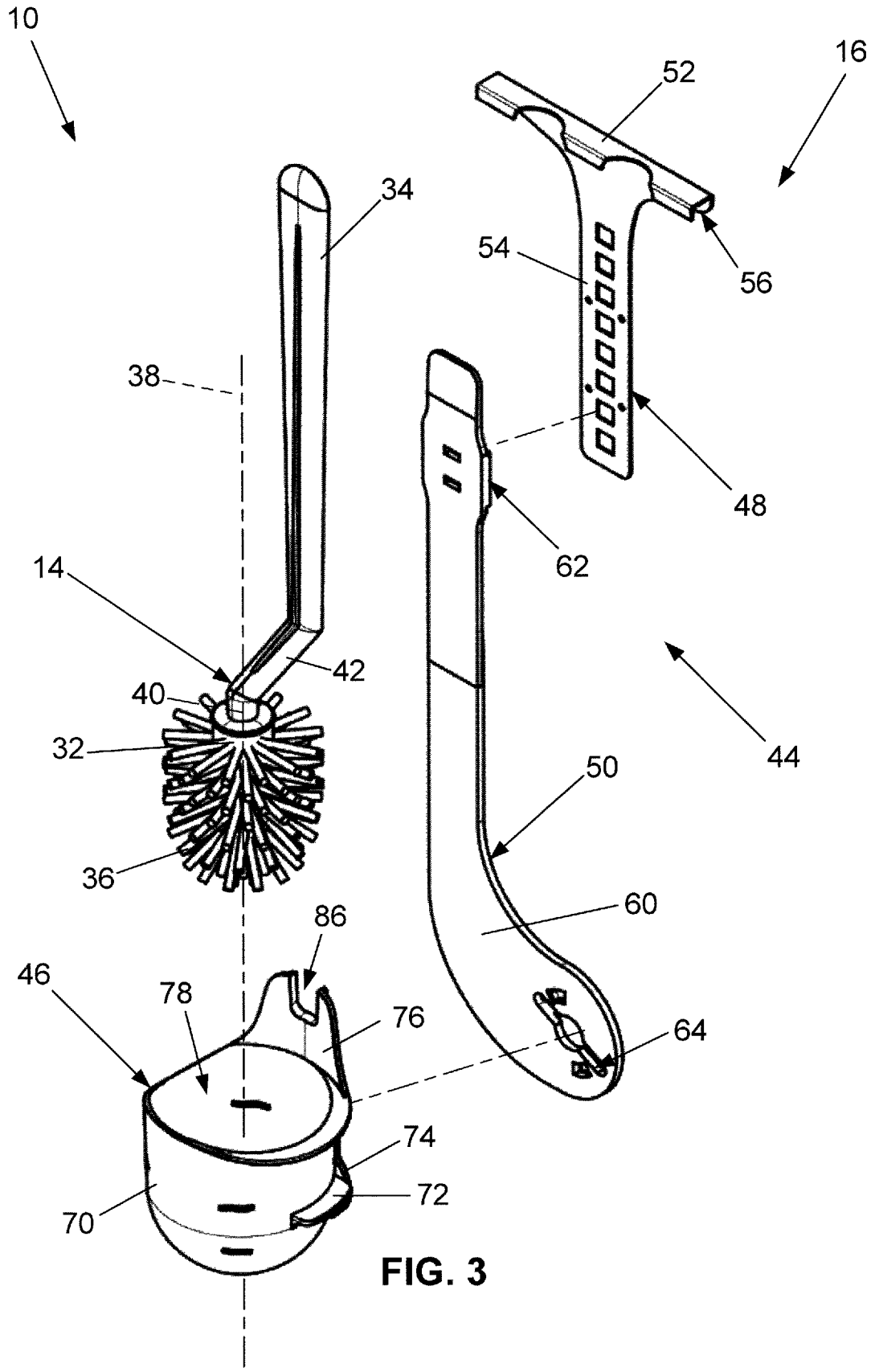
FIG. 3 is an exploded view of the toilet accessory and the accessory holder showing that the accessory holder includes the accessory support adapted to receive the toilet accessory and the hanger, and showing that the hanger includes a bracket shaped to receive a portion of the toilet to couple the accessory holder with the toilet and a locator arm that extends away from the bracket.
Figure 5:
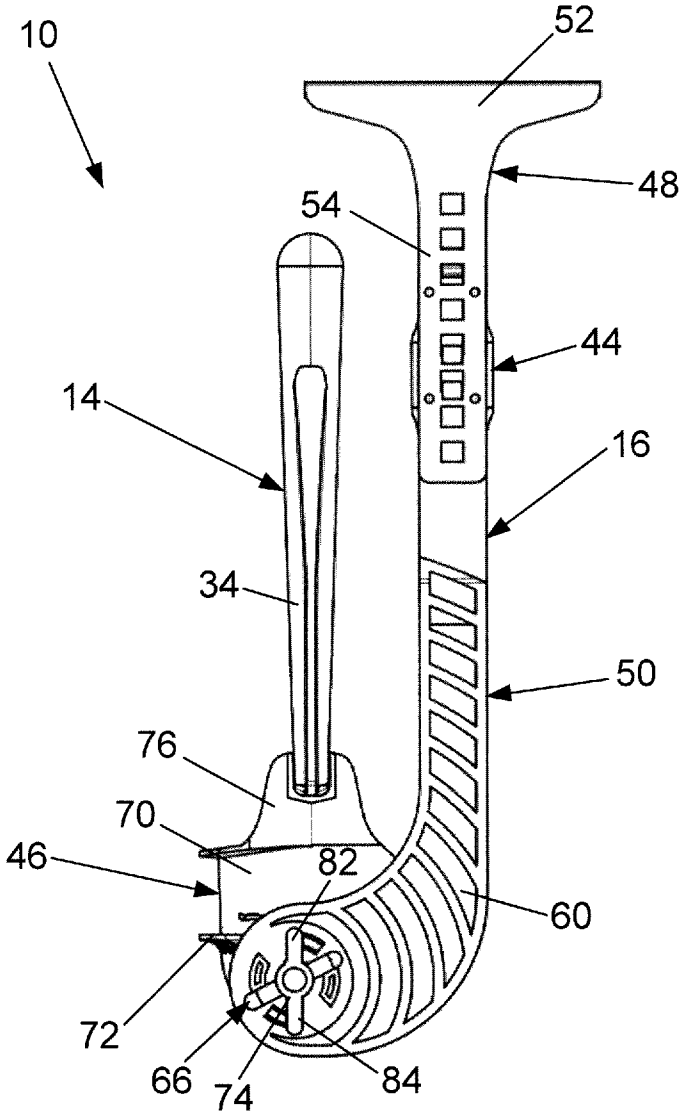
FIG. 5 is a rear elevation view of the toilet accessory and the accessory holder.
Figure 4:
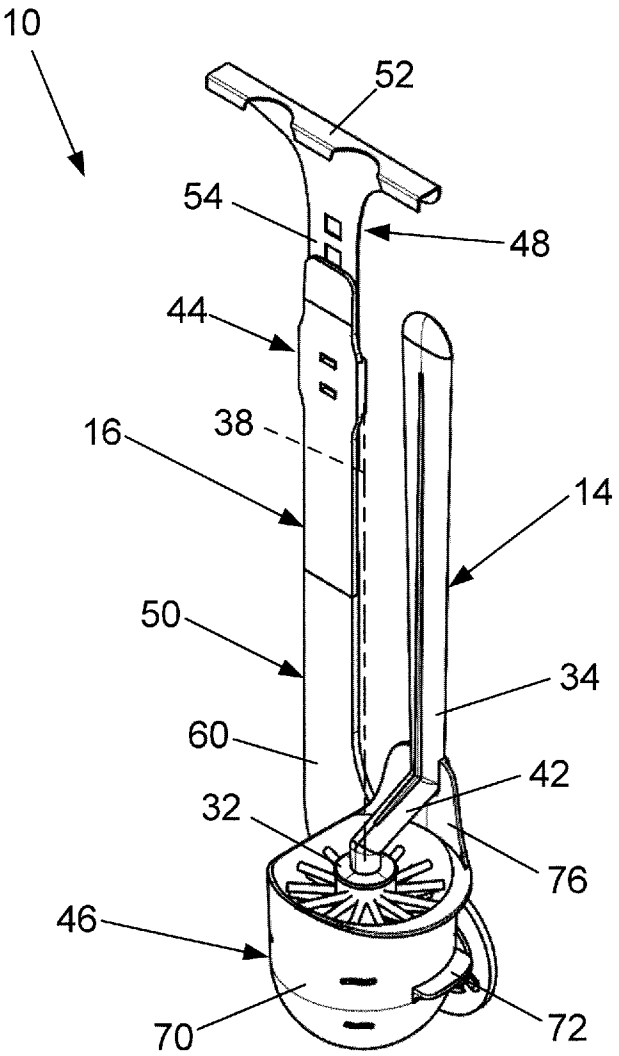
FIG. 4 is a perspective view of the toilet accessory and the accessory holder showing the toilet accessory received in and supported by the accessory holder.

The toilet accessory 14 is adapted for use with the toilet 12 and includes a head 32 and a grip 34 as shown in FIGS. 3-5. The head 32 is adapted to interface with the toilet 12. In the illustrative example, the head 32 includes a plurality of bristles 36 configured to clean the stool 18 of the toilet 12. In other embodiments, the head 32 may include a fluid nozzle or a suction cup. The grip 34 is coupled to the head 32 and sized to be held in a hand of the user to allow the user to hold the toilet accessory 14.

The head 32 defines a head axis 38 that extends vertically through a center 40 of the head 32 when the toilet accessory 14 is in the hidden position as shown in FIGS. 3 and 4. The plurality of bristles 36 extend radially outward away from the head axis 38.

The grip 34 is spaced apart from the head axis 38 as shown in FIGS. 3 and 4. The grip 34 is spaced apart from the head axis 38 to provide a space for the water tank 20 when the holder means 16 is in the first position as shown in FIG. 1. As a result, the grip 34 is not pushed out of a desired position by the water tank 20 when the toilet accessory 14 is received in the holder means 16. In the illustrative embodiment, the grip 34 is rigid. The grip 34 may define a handle.

The toilet accessory 14 further includes an offset neck 42 that extends from the head axis 38 to the grip 34 of the toilet accessory 14 as shown in FIGS. 3 and 4. In the illustrative embodiment, the offset neck 42 extends from the head 32 to the grip 34.

The accessory holder 16 is adapted to mount the toilet accessory 14 to the water tank 20 for movement between the first position and the second position as suggested in FIGS. 1 and 2. In the first position, at least a portion of the grip 34 included in the toilet accessory 14 is blocked from view behind the water tank 20 when the toilet is viewed from the front side 24. In the second position, the previously hidden portion of the grip 34 included in the toilet accessory 14 is visible to a user when the toilet 12 is viewed from the front side 24 so that the user can remove the toilet accessory 14 from the holder means 16.

The accessory holder 16 includes a hanger 44 and an accessory support 46 as shown in FIG. 3-5. The hanger 44 couples the holder means 16 to the water tank 20 as shown in FIGS. 1 and 2. The accessory support 46 is coupled to the hanger 44 for movement relative to the hanger 44. The accessory support 46 supports the toilet accessory 14 in both the hidden position and the revealed position.

The hanger 44 includes a bracket 48 and a locator arm 50 as shown in FIGS. 3-5. The bracket 48 couples the accessory holder 16 to the water tank 20 as shown in FIG. 1. The locator arm 50 extends downwardly away from the bracket 48 and is coupled to the accessory support 46 to locate the accessory support 46 beneath the water tank 20.

The bracket 48 is illustratively T-shaped and includes an anchor 52 and a height adjuster 54 that extends downwardly away from the anchor 52 as shown in FIGS. 3-5. The anchor 52 couples the hanger 44 to the toilet 12. The height adjuster 54 cooperates with the locator arm 50 to adjust a height of the hanger 44 and, thus, adjust a position of the accessory support 46 relative to a bottom of the water tank 20. In this way, the bracket 48 may be adjusted for different height water tank 20. In other embodiments, the anchor 52 may be elongated and the height adjuster 54 may be omitted such that the bracket 48 is not adjustable. In some such embodiments, the bracket 48 and the locator arm 50 are integrally formed. In the illustrative embodiment, the height adjuster 54 has a width that is less than a width of the anchor 52. The locator arm 50 is coupled to the bracket 48 for movement relative to the bracket 48 to change the distance from the bracket 48 to the accessory support 46.

The anchor 52 is shaped to define a downwardly opening channel 56 that receives at least a portion of the water tank 20 as shown in FIGS. 1 and 3. In the illustrative example, the water tank 20 includes a rear tank wall that defines the back side 26 of the toilet 12. The channel 56 receives at least a portion of the rear tank wall to couple the hanger 44 to the water tank 20 of the toilet 12. The downwardly opening channel 56 may be U-shaped. In the illustrative embodiment, the channel 56 is formed by two 90 degree angles. In the illustrative embodiment, the anchor 52 is scalloped as shown in FIGS. 3 and 4.

The height adjuster 54 is formed to include a plurality of tab-receiver apertures 58 as shown in FIG. 6. Each of the plurality of tab-receiver apertures 58 are linearly spaced apart from one another in a vertical direction. The plurality of tab-receiver apertures 58 are configured to receive anchor tabs 62 included in the locator arm 50 to couple the locator arm 50 to the hanger 44 at a plurality of different vertical positions. In the illustrative embodiment, a length of the hanger 44 is adjustable between about 12 inches to about 15.75 inches.

The tab-receiver apertures 58 are rectangular in the illustrative example as shown in FIG. 6. The height adjuster 54 is formed to include eight tab-receiver apertures 58. In other embodiments, the height adjuster 54 may be formed to include any number and any shape of tab-receiver apertures 58.

The locator arm 50 includes a generally L-shaped member 60, the anchor tabs 62, and anti-rotation tabs 64 as shown in FIGS. 3, 6, and 7. The L-shaped member 60 couples hanger 44 with accessory support 46. The anchor tabs 62 extend into the tab-receiver apertures 58 to couple the locator arm 50 to the bracket 48. The anti-rotation tabs 64 limit rotation of the accessory support 46 relative to the locator arm 50.

The L-shaped member 60 is formed to include an aperture 66 located at a lower end of the L-shaped member 60 as shown in FIG. 7. The aperture 66 is sized to receive a rotator flange 74 included in the accessory support 46 as suggested in FIG. 9. The aperture 66 includes a central circular shaped hole and an elongated slot that extends through the central circular shaped hole.

The anchor tabs 62 extend away from the L-shaped member 60 toward the bracket 48 as shown in FIG. 6. Two anchor tabs 62 are L-shaped and configured to extend into the tab-receiver apertures 58 and engage a portion of the height adjuster 54. Another anchor tab 62 is spaced apart vertically from the other two tabs 62 and extends into one of the tab-receiver apertures 58. In the illustrative embodiment, the locator arm 50 further includes guide rails 68 aligned with the anchor tabs 62.

The anti-rotation tabs 64 extend away from the L-shaped member 60 and away from the accessory support 46 as shown in FIGS. 7 and 9. The anti-rotation tabs 64 are located adjacent the aperture 66 formed in the L-shaped bracket 60. The anti-rotation tabs 64 includes two tabs 64 that are spaced apart from each other by about 180 degrees. Each tab 64 is arcuate and extends along about 45 degrees. As such, the anti-rotation tabs 64 limit rotation of the accessory support 46 to about 45 degrees in each direction relative to vertical as suggested in FIG. 2.

The accessory support 46 includes a body 70, an actuator 72, the rotator flange 74, and a grip support 76, as shown in FIGS. 8 and 9. The body 70 is formed to define an accessory-receiver cavity 78 sized to receive the toilet accessory 14. The actuator 72 extends away from the body 70 and provides a lever arm configured to be urged by the user to rotate the accessory support 46. The rotator flange 74 rotatable couples the accessory support 46 with the hanger 44. The grip support 76 provides a rest for the grip 34 included in the toilet accessory 14. In some embodiments, the accessory support 46 extends underneath the water tank 20 of the toilet 12.

The body 70 is circular when viewed from above looking down as suggested in FIG. 4. The body 70 has a rounded bottom that has a center aligned with the head axis 38. The body 70 is formed to include a plurality of drain holes around a side wall of the body 70. The body 70 has a diameter that is about equal to a diameter of the plurality of bristles 36 in the illustrative embodiment.

The rotator flange 74 extends away from the body 70 toward the hanger 44 as shown in FIG. 9. The rotator flange 74 includes a center 80, a first flange 82 that extends away from the center 80, and a second flange 84 that extends away from the center 80 opposite the first flange 82. The center 80 is offset from the head axis 38 as shown in FIG. 8. The offset center 80 may help rotate the accessory support 46 when activated due to the weight of the accessory support 46 and the toilet accessory 14. The first and second flanges 84 are spaced apart from the body 70 and extend through the aperture 66 formed in the L-shaped member 60. The accessory support 46 is then rotate to move the flanges 82, 84 out of alignment with the aperture 66. As a result, the accessory support 46 is blocked from being separated from the hanger 44.

The grip support 76 extends upwardly away from the body 70 as shown in FIGS. 8 and 9. The grip support 76 extends partway circumferentially about the body 70. In the illustrative embodiment, the grip support 76 extends circumferentially less than about 45 degrees around the body 70. The grip support 76 includes a rounded top that is formed to define a cutout 86 sized to receive the grip 34 included in the toilet accessory 14.

Another embodiment of a toilet system 210 is shown in FIG. 10. The toilet system 210 is substantially similar to the toilet system 10 shown in FIGS. 1-9 and described herein. Accordingly, similar reference numbers in the 200 series indicate features that are common between the toilet system 10 and the toilet system 210. The description of the toilet system 10 is incorporated by reference to apply to the toilet system 210 except in instances when it conflicts with the specific description and the drawings of the toilet system 210.

The toilet system 210 includes the toilet 12, the toilet brush accessory 14, and an accessory holder 216 as shown in FIG. 10. The accessory holder 216 includes a hanger 244 and the accessory support 46. The hanger 244 includes a bracket 248 and a locator arm 250 that are integrally formed as shown in FIG. 10.

The bracket 248 is substantially flat and includes adhesive material 290 configured to couple the holder means 216 to the water tank 20. The locator arm 250 includes an L-shaped member 260 with aperture 66 and anti-rotation tabs 64 to couple the hanger 244 to the accessory support 46.

Another embodiment of a toilet system 310 is shown in FIG. 11. The toilet system 310 is substantially similar to the toilet system 10 shown in FIGS. 1-9 and described herein. Accordingly, similar reference numbers in the 300 series indicate features that are common between the toilet system 10 and the toilet system 310. The description of the toilet system 10 is incorporated by reference to apply to the toilet system 310 except in instances when it conflicts with the specific description and the drawings of the toilet system 310.

The toilet system 310 includes the toilet 12, the toilet brush accessory 14, and an accessory holder 316 as shown in FIG. 11. The accessory holder 316 includes a hanger 344 and an accessory support 346. The hanger 344 includes a bracket 348 and a locator arm 350 that are integrally formed as shown in FIG. 11. The bracket 348 is formed to include a downward opening channel that receives a portion of the water tank 20 to couple the holder means 316 to the toilet 12.

The locator arm 350 includes a member 360 that extends away from the bracket 348 and a slide rail 392 coupled to the member 360. The slide rail 392 is generally perpendicular to the member 360 in the illustrative embodiment. The slide rail 392 extends a length on each side of the member 360. The accessory support 346 includes a body 370 sized to receive the toilet accessory 14, a grip support 376 that extends upward and away from the body 370, and a guide rail 394 coupled to the body 270. The guide rail 394 couples with the slide rail 392 included in the locator arm 350 to allow the accessory support 346 to slide relative to the hanger 344 between the first position and second position. The accessory support 346 is coupled to the hanger 344 to slide along an axis from the first position corresponding with the hidden position of the toilet accessory 14 to the second position corresponding with the revealed position of the toilet accessory 14.

Another embodiment of a toilet system 410 is shown in FIGS. 12 and 13. The toilet system 410 is substantially similar to the toilet system 10 shown in FIGS. 1-9 and described herein. Accordingly, similar reference numbers in the 400 series indicate features that are common between the toilet system 10 and the toilet system 410. The description of the toilet system 10 is incorporated by reference to apply to the toilet system 410 except in instances when it conflicts with the specific description and the drawings of the toilet system 410.

The toilet system 410 includes the toilet 12, a toilet plunger accessory 414, and an accessory holder 416 as shown in FIGS. 12 and 13. The toilet plunger accessory 414 includes a head 432 and a grip 434 as shown in FIG. 13. The head 432 includes a suction cup 432 such that the toilet accessory 414 provides a plunger configured to unclog the stool 18 of the toilet 12. The grip 434 is coupled to the head 432 and sized to be held in a hand of the user.

The head 432 defines a head axis 438 that extends through a center of the head 432. The suction cup 432 is arranged circumferentially around the head axis 438. The grip 434 is spaced apart from the head axis 438 to provide a space for the water tank 20. The grip 434 may be rigid and the grip 434 may define a handle. In some embodiments, the toilet accessory 414 further includes an offset neck that extends from the head axis 438 to the grip 434 of the toilet accessory 414.

The accessory support 446 is sized to receive the suction cup 432 of the toilet accessory 414 as shown in FIGS. 12 and 13. In the illustrative embodiment, the accessory support 446 is circular shaped when viewed along the head axis 448. The accessory support 446 may be shallow as compared to the accessory support 46.

Another embodiment of a toilet system 510 is shown in FIGS. 14 and 15. The toilet system 510 is substantially similar to the toilet system 10 shown in FIGS. 1-9 and described herein. Accordingly, similar reference numbers in the 500 series indicate features that are common between the toilet system 10 and the toilet system 510. The description of the toilet system 10 is incorporated by reference to apply to the toilet system 510 except in instances when it conflicts with the specific description and the drawings of the toilet system 510.

The toilet system 510 includes the toilet 12, a toilet cleaner-container accessory 514, and an accessory holder 516 as shown in FIGS. 14 and 15. The toilet accessory 514 includes a head 532 and a grip 534 as shown in FIG. 15. The head 532 includes a fluid nozzle 532 and the grip 534 is shaped to form a fluid reservoir 534 such that the toilet accessory 514 provides a bottle configured to store and dispense toilet cleaner. The grip 534 is coupled to the head 532 and sized to be held in a hand of the user.

The accessory support 546 is sized to receive the fluid reservoir 534 of the toilet accessory 514 as shown in FIGS. 14 and 15. In the illustrative embodiment, the accessory support 546 includes a sidewall 596 and a cutout 598 formed in the sidewall 596. The accessory support 546 further includes an actuator 572 coupled to the sidewall 596. The accessory support 546 may be shallow as compared to the accessory support 46.

The present disclosure describes a toilet bowl cleaning brush holder 16 and toilet bowl cleaning brush 14. The disclosure describes a toilet bowl cleaning brush holder 16 that hangs from a toilet tank 20. According to one aspect of the present disclosure, the toilet bowl cleaning brush holder 16 hangs from the backside 26 of a toilet tank 20. A hanger 44 attaches to the toilet tank 20 and extends beyond a bottom of the toilet tank 20. A cup 46 is attached to a bottom of the hanger 44 to allow the toilet bowl cleaning brush 14 to be inserted into the cup 46.

Cleaning brush holder 16 may have multiple parts and may include the toilet bowl cleaning brush holder hanger 44 and the toilet bowl cleaning brush cup 46. The cup 46 is coupled to the hanger 44. Referring to FIG. 1 there is shown the toilet bowl cleaning brush holder 16 hanging on a toilet tank 20. The hanger 44 hangs over the edge of the toilet tank 20 and then connects to the cup 46. The cup 46 can rotate to allow the toilet bowl brush 14 to be inserted into the cup 46. The shapes, dimensions, materials of construction, arrangements of the parts, etc. of the various embodiments of the invention as shown in FIG. 1 are illustrative and any shapes, dimensions, materials of construction, arrangements of the parts, etc. may be used.

The toilet bowl cleaning brush 14 is shown removed from the toilet bowl cleaning brush cup 46 in FIG. 3. The toilet bowl cleaning brush holder 16 after the cup 46 has been rotated relative to the hanger 44 is shown in FIG. 2. The toilet bowl cleaning brush holder 16 is shown installed on the toilet tank 20 with the toilet bowl brush inserted in FIG. 1. FIG. 3 shows the toilet bowl cleaning brush holder 16 including the hanger 44 and the cup 46.

FIG. 10 shows another possible configuration of a toilet bowl cleaning brush holder 216. This view shows the toilet bowl cleaning brush holder 216 after the cup 46 has been rotated. The toilet bowl cleaning brush holder 216 is to be attached to the toilet tank 20 by adhering the hanger 244 with adhesive material 290 to the toilet tank 20.

FIG. 11 shows another possible configuration of a toilet bowl cleaning brush holder 316. This view shows the toilet bowl cleaning brush holder 316 with the cup 46 mounted to a slide rail 392. The toilet bowl cleaning brush holder hanger 344 hangs over the edge of the toilet tank 20.

Designs in accordance with the present disclosure may provide the ability to hang a toilet bowl cleaning brush 14 from the toilet tank 20. Such designs place the toilet bowl brush 14 and toilet bowl cleaning brush holder 16 out of sight and off the floor. The toilet bowl cleaning brush holder hangs from the toilet tank and holds the toilet bowl cleaning brush in the toilet bowl cleaning brush holder cup. The toilet bowl cleaning brush holder hangs from the backside of a toilet tank. The hanger extends beyond the bottom of the toilet tank and hangs on the outside of the toilet tank. A cup is attached to the bottom of the hanger to allow a toilet bowl cleaning brush to be inserted.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

The invention claimed is:

1. A toilet system, the toilet system comprising a toilet including a stool that defines a front side of the toilet, a water tank fluidly coupled to the stool that defines a back side of the toilet, and a lid that closes the water tank and that defines a top side of the toilet, a toilet accessory adapted for use with the toilet, the toilet accessory including a head and a grip sized to be held in a hand of a user, and holder means for mounting the toilet accessory to the water tank for movement from a hidden position in which at least a portion of the grip included in the toilet accessory is blocked from view behind the water tank when the toilet is viewed from the front side to a revealed position in which the previously hidden portion of the grip included in the toilet accessory is visible to a user when the toilet is viewed from the front side so that the user can remove the toilet accessory from the holder means for use.

2. The toilet system of claim 1, wherein the holder means includes a hanger coupled to the water tank of the toilet and an accessory support that engages the toilet accessory to support the toilet accessory in both the hidden position and the revealed position, and the accessory support is coupled to the hanger for movement relative to the hanger.

3. The toilet system of claim 2, wherein the hanger includes a bracket shaped to define a downwardly opening channel that receives at least a portion of a rear tank wall included in the water tank that defines the back side of the toilet to couple the hanger to the water tank of the toilet.

4. The toilet system of claim 2, wherein the hanger includes a bracket coupled to a rear tank wall included in the water tank that defines the back side of the toilet and a locator arm that extends from the bracket to a point below the water tank of the toilet, and the accessory support is coupled to the locator arm below the water tank.

5. The toilet system of claim 4, wherein the locator arm is coupled to the bracket for movement relative to the bracket to change a distance from the bracket to the accessory support.

6. The toilet system of claim 4, wherein the accessory support extends underneath the water tank of the toilet.

7. The toilet system of claim 2, wherein the accessory support is coupled to the hanger to pivot about an axis from a first position corresponding with the hidden position of the toilet accessory to a second position corresponding with the revealed position of the toilet accessory.

8. The toilet system of claim 7, wherein the accessory support is arranged underneath the water tank of the toilet when the accessory support is in the first position and wherein the holder means includes an actuator that extends from the accessory support to a location out from under the water tank of the toilet when the accessory support is in the first position, the actuator configured to be pushed downwardly by a user to move the accessory support from the first position corresponding with the hidden position of the toilet accessory to the second position corresponding with the revealed position of the toilet accessory.

9. The toilet system of claim 2, wherein the accessory support is coupled to the hanger to slide along an axis from a first position corresponding with the hidden position of the toilet accessory to a second position corresponding with the revealed position of the toilet accessory.

10. The toilet system of claim 1, wherein the head of the toilet accessory includes a plurality of bristles such that the toilet accessory provides a toilet brush, the grip of the toilet accessory is spaced apart from a brush axis that extends vertically through a center of the head of the toilet accessory when the toilet accessory is in the hidden position, and the toilet accessory includes an offset neck extends from the brush axis to the grip of the toilet accessory.

11. The toilet system of claim 1, wherein the head of the toilet accessory includes a suction cup such that the toilet accessory provides a plunger and the grip of the toilet accessory is spaced apart from a cup axis that extends vertically through a center of the suction cup of the toilet accessory when the toilet accessory is in the hidden position.

12. The toilet system of claim 1, wherein the head of the toilet accessory includes a fluid nozzle and the grip of the toilet accessory is shaped to form a fluid reservoir in communication with the fluid nozzle such that the toilet accessory provides a bottle configured to store and dispense toilet cleaner.

13. A toilet system adapted for use with a toilet including a water tank, the toilet system comprising a toilet accessory adapted for use with the toilet, the toilet accessory including a head and a grip sized to be held in a hand of a user, and holder means for mounting the toilet accessory to the water tank of the toilet for movement from a hidden position in which at least a portion of the grip included in the toilet accessory is blocked from view behind the water tank to a revealed position in which previously hidden portion of the grip included in the toilet accessory is visible to a user so that the user can remove the toilet accessory from the holder means for use.

14. The toilet system of claim 13, wherein the holder means includes a hanger configured to be coupled to the water tank of the toilet and an accessory support that engages the toilet accessory to support the toilet accessory in both the hidden position and the revealed position.

15. The toilet system of claim 14, wherein the accessory support is coupled to the hanger to pivot about an axis from a first position corresponding with the hidden position of the toilet accessory to a second position corresponding with the revealed position of the toilet accessory.

16. The toilet system of claim 14, wherein the hanger includes a bracket shaped to define a downwardly opening channel sized to receive at least a portion of a rear tank wall included in the water tank of the toilet.

17. The toilet system of claim 14, wherein the hanger includes a bracket configured to be coupled to a the water tank and a locator arm that extends from the bracket, the accessory support is coupled to the locator arm, and the locator arm is coupled to the bracket for movement relative to the bracket to change a distance from the bracket to the accessory support.

18. The toilet system of claim 13, wherein the head of the toilet accessory includes a plurality of bristles such that the toilet accessory provides a toilet brush, the grip of the toilet accessory is spaced apart from a brush axis that extends through a center of the head of the toilet accessory, and the toilet accessory includes an offset neck extends from the brush axis to the grip of the toilet accessory.

19. A toilet system adapted for use with a toilet including a water tank, the toilet system comprising a toilet accessory adapted for use with the toilet, the toilet accessory including a head and a grip sized to be held in a hand of a user, and an accessory holder including a hanger configured to be coupled to the water tank of the toilet and an accessory support that supports the toilet accessory, wherein the accessory support is movable relative to the hanger from a hidden position in which the grip included in the toilet accessory is generally parallel to a line defined by a height of the hanger to a revealed position in which the grip included in the toilet accessory forms an angle with the line defined by the height of the hanger.

20. The toilet system of claim 19, wherein the accessory support is coupled to the hanger to pivot about an axis from the hidden position to the revealed position.

* * * * *